US010182972B2

(12) United States Patent
Trawick et al.

(10) Patent No.: US 10,182,972 B2
(45) Date of Patent: Jan. 22, 2019

(54) FLEXIBLE SEALING LID AND CONNECTOR DEVICE FOR A DRINK CONTAINER

(71) Applicants: Yesica Viviana Trawick, Gaithersburg, MD (US); Esther Paulina Gallego, Gaithersburg, MD (US)

(72) Inventors: Yesica Viviana Trawick, Gaithersburg, MD (US); Esther Paulina Gallego, Gaithersburg, MD (US)

( * ) Notice: Subject to any disclaimer, the term of this patent is extended or adjusted under 35 U.S.C. 154(b) by 179 days.

(21) Appl. No.: 15/060,851

(22) Filed: Mar. 4, 2016

(65) Prior Publication Data

US 2016/0256359 A1 Sep. 8, 2016

Related U.S. Application Data

(60) Provisional application No. 62/176,985, filed on Mar. 4, 2015.

(51) Int. Cl.

| | |
|---|---|
| ***B65D 47/06*** | (2006.01) |
| ***A61J 9/08*** | (2006.01) |
| ***B65D 55/16*** | (2006.01) |
| ***A61J 11/00*** | (2006.01) |
| ***B65D 45/02*** | (2006.01) |

(52) U.S. Cl.

CPC ..... *A61J 9/085* (2013.01); *A61J 11/0085* (2013.01); *B65D 45/02* (2013.01); *B65D 47/06* (2013.01); *B65D 55/16* (2013.01); *B65D 2231/022* (2013.01)

(58) Field of Classification Search

CPC ..... B65D 55/16; B65D 41/30
USPC ..... 220/287
See application file for complete search history.

(56) References Cited

U.S. PATENT DOCUMENTS

| | | | | |
|---|---|---|---|---|
| 524,159 | A * | 8/1894 | Birnbaum | B65D 41/28 215/277 |
| 2007/0199914 | A1* | 8/2007 | Hung | B65D 47/243 215/311 |
| 2009/0134112 | A1* | 5/2009 | Reeves | B65D 55/16 215/11.6 |

* cited by examiner

*Primary Examiner* — Jeffrey Allen
(74) *Attorney, Agent, or Firm* — William E. Noonan

(57) ABSTRACT

A flexible sealing lid and connector device for a drink container includes a container attachment band for wrapping around and attaching to the drink container. A resiliently flexible lid component is interconnected by a flexible connector element to the container attachment band. The lid component includes a neck portion for resiliently expanding to receive and sealably grip a periphery of the drink container such that the lid component covers a liquid dispensing opening of the drink container.

17 Claims, 6 Drawing Sheets

FLEXIBLE SEALING LID AND CONNECTOR DEVICE FOR A DRINK CONTAINER

RELATED APPLICATION

This application claims the benefit of U.S. Provisional Patent Application Ser. No. 62/176,985 filed Mar. 4, 2015.

FIELD OF THE INVENTION

This invention relates to a flexible sealing lid and connector device and, more particularly, to a device that is releasably secured to a drink container, such as a baby bottle or cup, and includes a flexible lid for gripping and sealably covering the container.

BACKGROUND OF THE INVENTION

Baby bottles are traditionally equipped with a lid or closure that is snapped onto the bottle so that the nipple is covered when the bottle is not in use. Such lids are often misplaced or lost. This leaves the nipple exposed to potential contamination. An uncovered nipple is also apt to allow milk or other contents of the bottle to leak or spill through the uncovered nipple. This can create an aggravating mess and damage a carrying bag, purse or other item in which the baby bottle is being carried.

Efforts have been made to attach the existing lid to the baby bottle so that it is less likely to be misplaced or lost. See, for example, the baby bottle cap holder disclosed in US Publication No. 2005/0109725. Unfortunately, the existing bottle lid can still become separated from the holder and misplaced or lost. In addition, neither the foregoing bottle holder nor any other conventional item features a lid that sealably grips the baby bottle in a manner that effectively seals the nipple of the bottle closed. As a result, milk or other contents of the bottle tend to leak from the nipple, even when it is covered by the supplied lid. The contents may spill and have to be cleaned up and discarded when the lid is removed from the bottle.

Sippy cups, water bottles and even adult cups, such as travel coffee mugs, suffer from similar problems. Removable lids are often separated from the container, and as a result, misplaced or lost. Leaks and spills are commonplace.

SUMMARY OF THE INVENTION

It is therefore an object of the present invention to provide a flexible sealing lid and connector device that securely fastens a lid to a baby bottle or other drink container so that it remains held by the container when the lid is removed and which is therefore much less likely to be misplaced or lost.

It is a further object of this invention to provide a flexible sealing lid for a baby bottle wherein the lid is resiliently stretchable to grip and secure the bottle so that the nipple is both covered and sealed to protect it from contamination and effectively prevent the contents of the bottle from leaking or spilling through the covered nipple.

It is a further object of this invention to provide a flexible sealing lid and connector device that may be used effectively on virtually any brand or size of bottle or drink container.

It is a further object of this invention to provide a flexible sealing lid that provides an improved suction barrier within the lid when it is engaged with a baby bottle so that the contents of the bottle are not accidentally discharged through the nipple.

It is a further object of this invention to provide a flexible sealing lid and connector device that may be used effectively for sealing and resisting leakage and spilling from sippy cups, travel coffee cups and various other types of drink containers, and which is not readily separated from the container.

This invention results from a realization that an improved sealing lid for baby bottles, cups and other types of drink containers may be accomplished by utilizing a resiliently flexible lid component having a resiliently expandable neck that sealably grips the periphery of the baby bottle or other drink container such that the lid component more effectively seals the drink dispensing opening of the container. This, in turn, significantly reduces leaking and spillage of liquids from the container, which are commonly exhibited by conventional bottles and drink containers. This invention also reduces misplacement and potential loss of the lid by utilizing a one-piece construction wherein the flexible sealing lid is unitarily connected and permanently fixed to a container attachment band that is itself releasably attached to the bottle or other container covered by the lid.

This invention features a flexible sealing lid and connector device for a drink container having a liquid dispensing opening. The device includes a container attachment band for wrapping about and attaching to a drink container. An elongate flexible connector element is joined at a first end to the container attachment band. A resiliently flexible lid component is secured to an opposite second end of the connector element. The lid component includes a neck portion that is resiliently expandable to receive and sealingly grip a periphery of the drink container such that the lid component covers the liquid dispensing opening of the drink container.

In a preferred embodiment, the flexible sealing lid and connector device is used for a baby bottle having a liquid dispensing nipple. The resiliently flexible lid component may be secured to the elongate connector element by a lid attachment band that unitarily interconnects the lid component to an opposite, second end of the elongate connector element. The lid component may be collapsible when the neck portion grips the periphery of the container for creating a suction within the flexible lid component, which in turn causes the neck to more tightly grip and seal shut the drink container.

The lid component may include an interior chamber for receiving a standard drink container lid. The lid component may include an aperture for receiving a straw to communicate with an interior of the drink container. This feature is particularly effective for use when the container includes a traveling coffee mug or other type of portable drink container. In versions wherein the device is used for a baby bottle, the device may include a dome element received by the interior chamber of the lid component for sealably engaging the baby bottle nipple when the lid component is engaged with the baby bottle and covers the nipple of the bottle.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
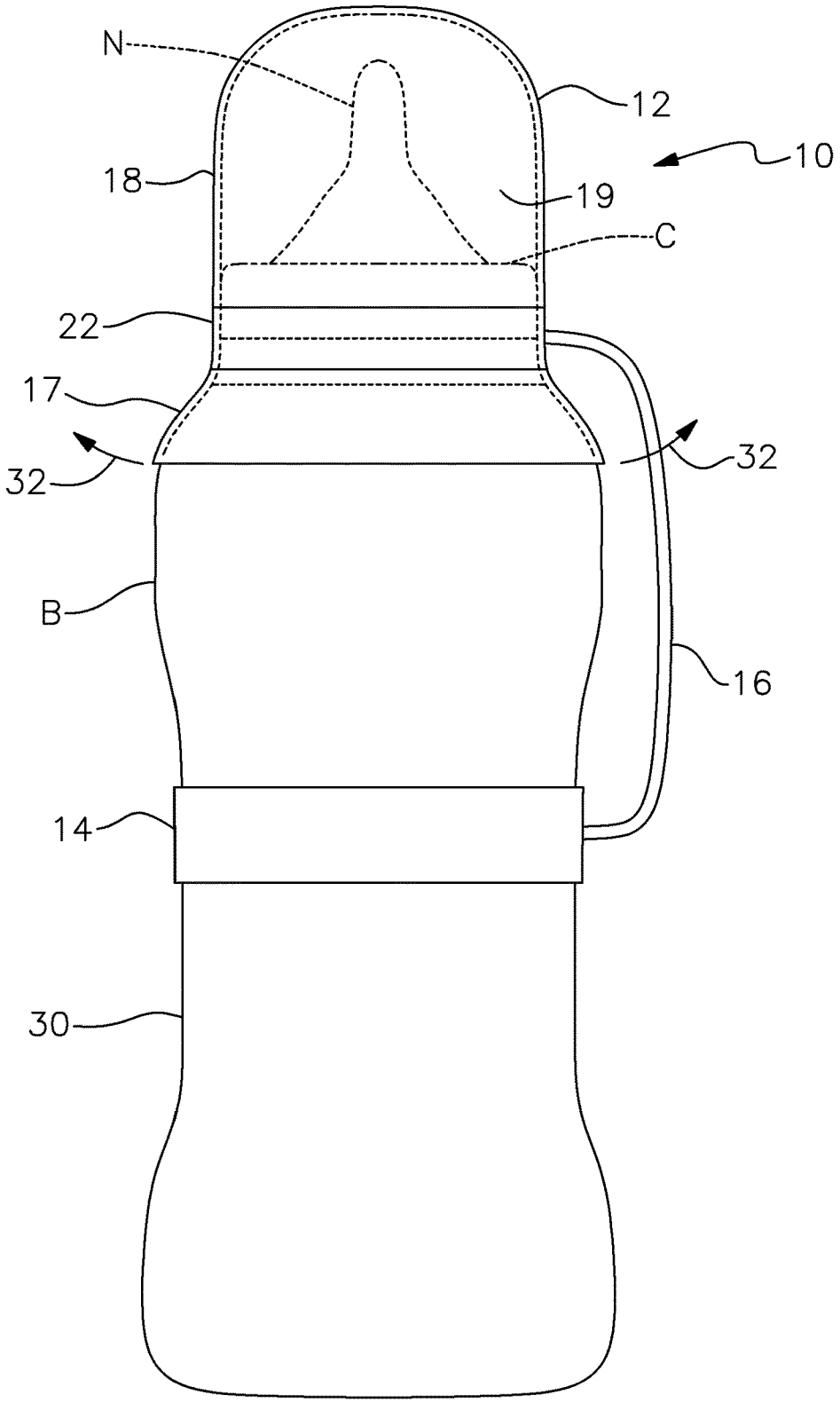
FIG. 1 is an elevational side view of a preferred flexible sealing lid and connector device operatively attached to a baby bottle and covering the liquid dispensing nipple of the bottle.
Figure 6:
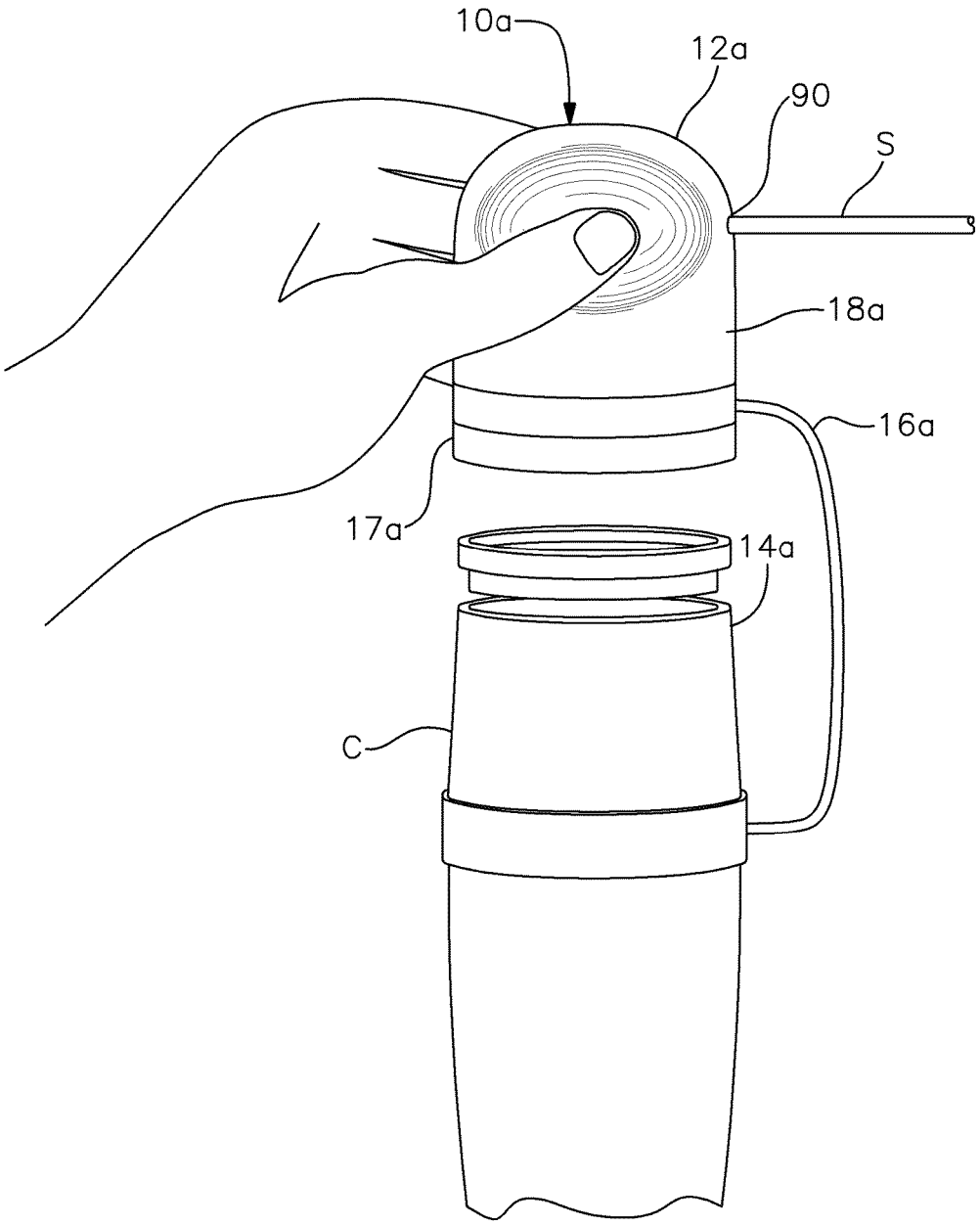
FIG. 6 is a perspective view of a version of the flexible sealing lid and connector device of this invention being utilized to cover and seal a traveling coffee cup or mug.

There is shown in FIG. 1 a flexible sealing lid and connector device 10 operatively attached to a baby bottle B. In certain preferred embodiments described herein, device 10 is used to sealably cover the upper end and attached nipple N of the baby bottle. However, in alternative embodiments, such as shown in FIG. 6, the sealing lid may be employed to similarly cover and seal various other types of drink container including, but not limited to, sippy cups, water bottles, travel coffee cups and mugs, etc. As used herein, the term "drink container" should be understood broadly to refer to and include any and all such items. The particular type of drink container with which the lid device may be employed should not be construed as a limitation of this invention.

Figure 2:
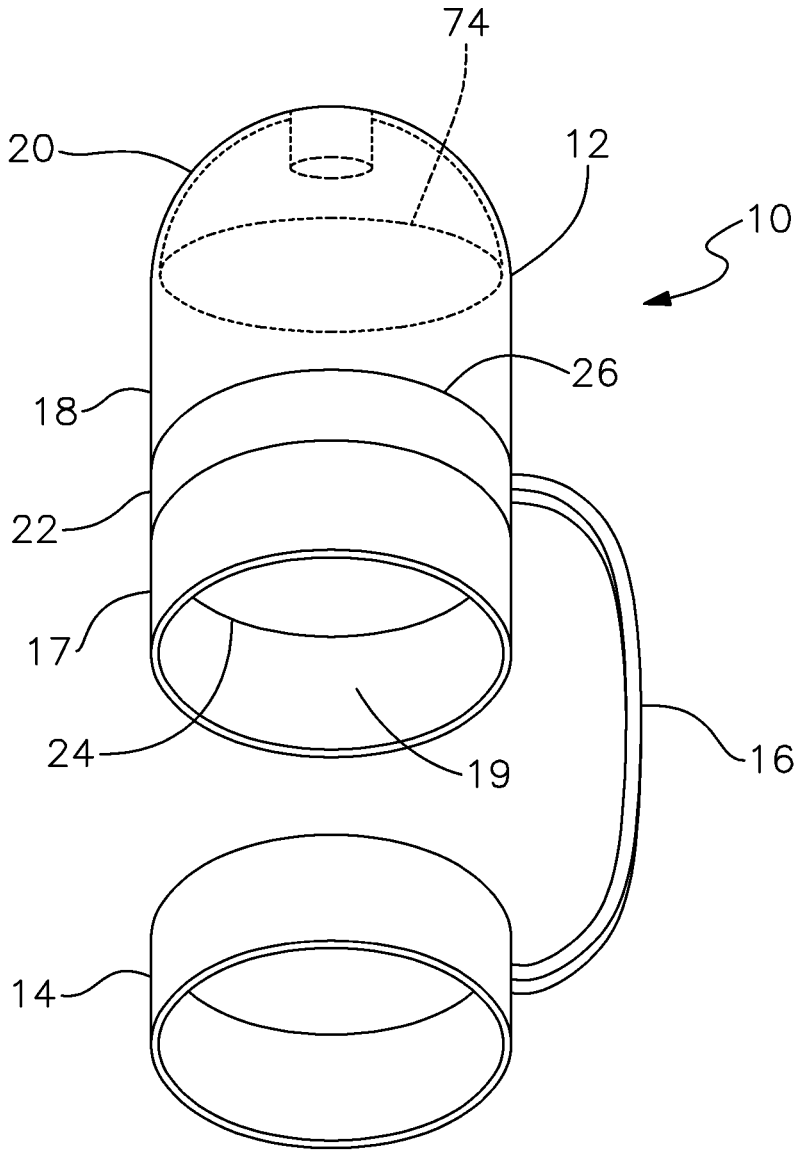
FIG. 2 is a perspective view of the device; an optional dome element for sealing the nipple of a baby bottle is disclosed within the lid component.
Figure 3:
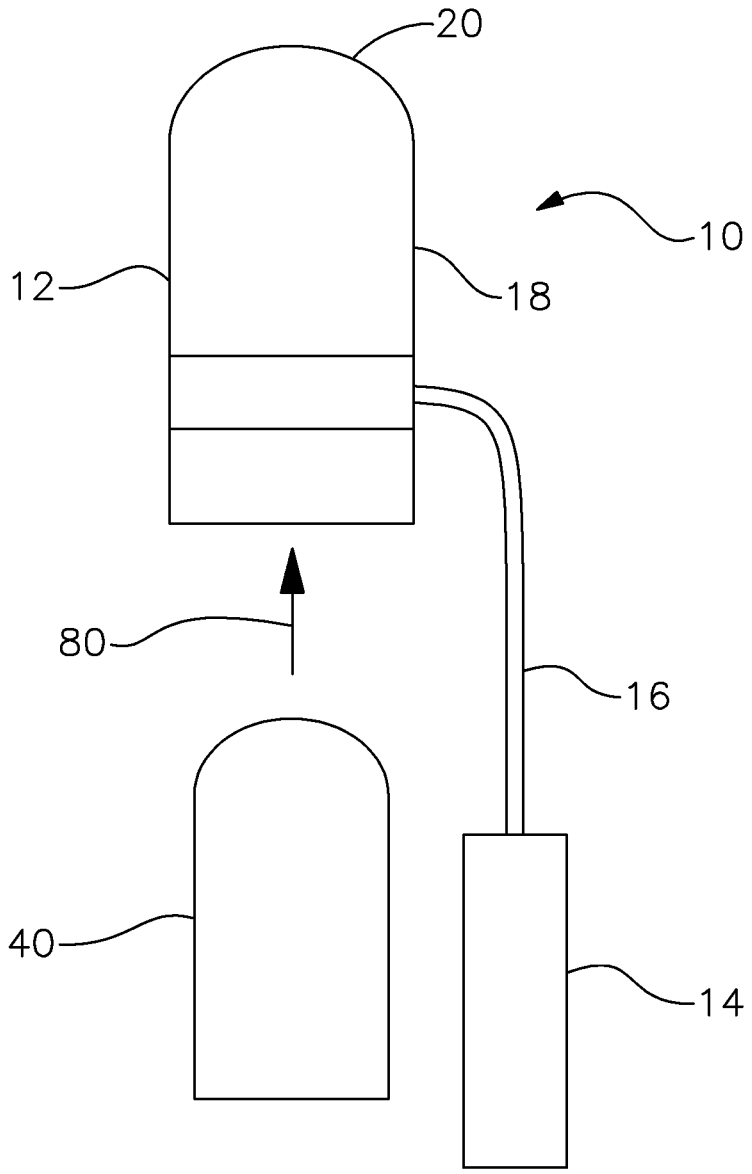
FIG. 3 is an elevational side view of the device shown in proximity with, and for receiving and gripping a standard lid conventionally provided with a baby bottle.

Device 10, which is depicted by itself in FIG. 2, comprises a flexible lid component 12 that is permanently interconnected to an annular container attachment band 14 by an elongate flexible connector element 16. The foregoing parts are preferably manufactured and interconnected in a unitary or a single piece construction. Each of lid component 12, attachment band 14 and connector element 16 typically includes a resiliently flexible material. A soft, elastomeric substance such as silicone is particularly preferred as being safe and effective for use with a baby bottle or child's sippy cup. Various alternative natural products, such as rubber, or synthetics/plastics, may also be employed within the scope of this invention. As shown in FIGS. 1-3, lid component 12 includes a cylindrical side wall 18 and a rounded or convex upper end 20 integrally joined to side wall 18. The lower end of the lid component's peripheral wall 18 includes a resiliently expandable neck 17 that operates to seal a bottle or other container closed in a manner described below. As best shown in FIG. 2, the lower end of lid component 12 is open and the lid component includes an interior chamber 19. The individual parts of device 10 may have various dimensions within the scope of this invention. Typically, lid component 12 has a diameter and a height that may vary between 2-4 inches. Connector element 16 may likewise be between about 2-4 inches in length. Bottle attachment strap 14 may have an un-stretched diameter of approximately 2-4 inches. Again, these dimensions maybe varied within the scope of this invention.

An annular lid attachment band 22 is wrapped about peripheral side wall 18 of lid component 12. Band 22 is typically molded or formed unitarily with lid component 12 and composed of the same material comprising the lid component. Essentially, band 22 is simply a relatively thick ring of material formed annularly about, and yet unitarily integrated with the side wall 18 of lid component 12. The flexible lid component 12 may be molded or otherwise manufactured such that, as best shown in FIG. 2, a lower circumferential edge 24 of band 22 protrudes a slight amount inwardly from peripheral wall 18 within interior chamber 19 and an upper edge 26 of band 22 protrudes outwardly a similar degree from the exterior surface of peripheral wall 18.

Connector element 16 is again composed of the resiliently flexible material forming lid component 12 and integral band 22. Connector element 16 may comprise a strap, cord or other type of elongate element. An upper end of connector element 16 is unitarily and permanently fastened to band 22. The opposite, lower end of element 16 is fastened in an identical manner to bottle or container attachment band 14. This band too is composed of resiliently flexible material as described above. Typically, band 14 is provided with a diameter that is slightly less than the diameter of the baby bottle or other drink container with which device 10 is used.

Device 10 is operatively engaged and used with a baby bottle B or other type of drink or beverage container in one of several different ways. For example, as shown in FIG. 1, device 10 may be attached to bottle B so that the lid device sealably covers and encloses both the baby bottle nipple N and the screw on cap C, which are shown in phantom. In particular, bottle attachment band 14 is stretched open and the baby bottle container 30 is inserted through band 14. The lower attachment band is then allowed to return to its normal un-stretched diameter so that it snugly and securely grips the circumference of bottle container 30 as shown. Flexible lid component 12 is then placed over nipple N and cap C of bottle B and the upper end of the baby bottle is inserted into interior chamber 19 of lid component 12. The entire lid component is pulled or otherwise manipulated in a manner similar to pulling on a glove such that the lid component is pulled sealingly over the upper end of bottle B. In particular, resiliently expandable neck portion 17 of lid component 12 is stretched or resiliently expanded in the manner indicated by arrows 32. The expanded neck thereby sealably grips the outer surface of bottle B and, more particularly, bottle container 30. As a result, nipple N is sealably covered. Formula, milk or other contents of bottle B are thereby restricted from leaking or spilling from the engaged lid component 12.

While device 10 remains engaged with bottle B, flexible connector element 16 secures lid component 12 to attachment band 14, even when the lid component is disengaged and removed from the upper end of bottle B. This permits a baby to be fed or liquid to be otherwise dispensed through nipple N as needed. This secure and permanent means of attachment prevents misplacement and potential loss of lid component 12. Unlike conventional devices, lid component 12 is not detachable from either integral band 22 or connector element 16. As a result, it is much more difficult to misplace or lose the lid component 12 as long as device 10 remains attached to the bottle or drink container by means of band 14.

Figure 4:
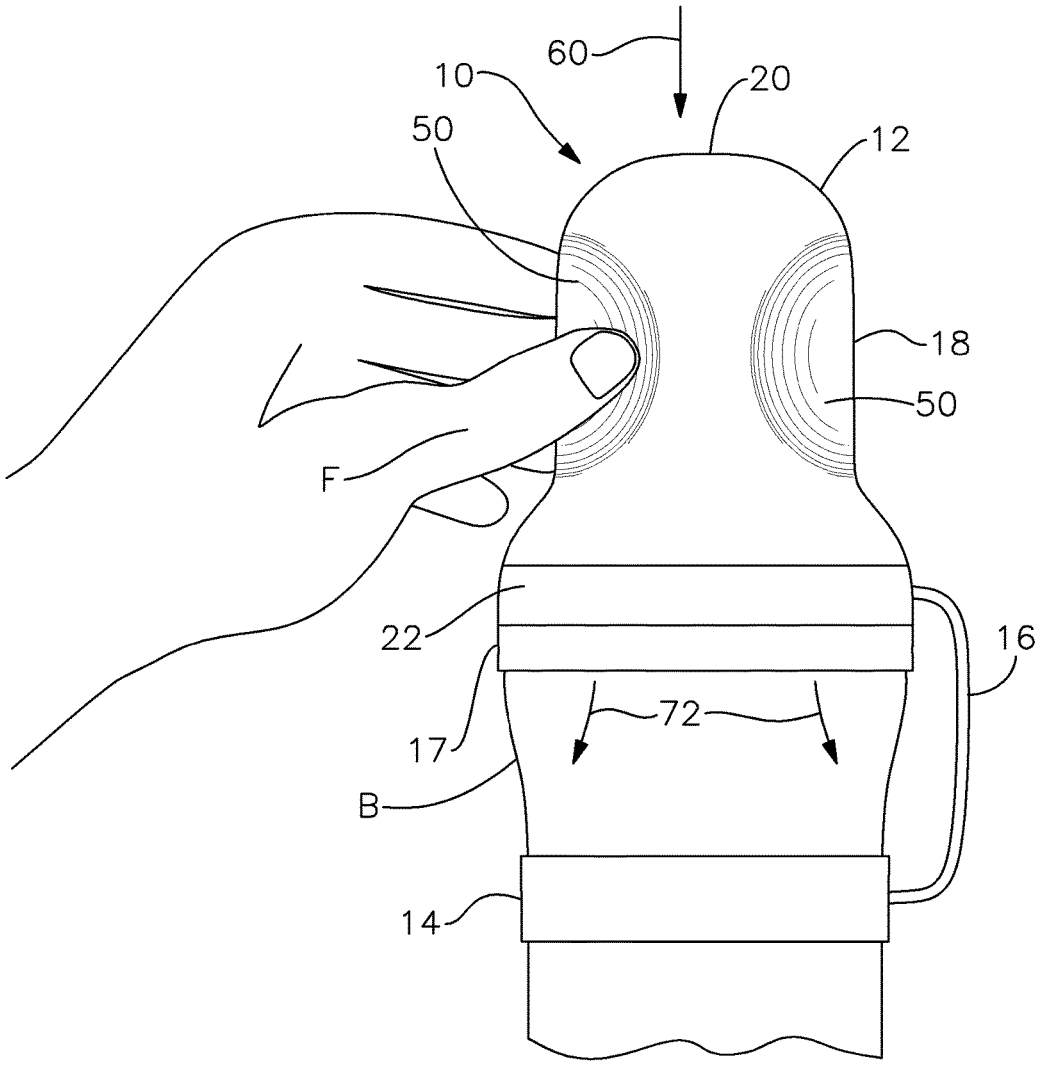
FIG. 4 is a partial elevational side view of a baby bottle with the sealing lid and connector device operatively attached thereto and further depicting the lid component being collapsed by hand to create an air suction within the flexible lid and an improved seal for the bottle such that spillage and leakage through the nipple is reduced.

Device 10 can be used conveniently to sealably cover a baby bottle in the manner shown in FIG. 1 when a standard bottle lid (which is conventionally supplied with the bottle) is either lost or unavailable. Device 10 may also be employed as shown in FIG. 1 for bottles which do not include a standard lid or closure. In such cases, nipple N can be sealed even more effectively by manually collapsing lid component 12 in the manner shown in FIG. 4. After device 10 is engaged with bottle 12 in the manner previously described, and after resiliently expandable neck 17 of lid component 12 is stretched and engaged with the exterior surface of bottle B, lid component 12 is collapsed in the manner shown in FIG. 4 by pressing flexible side wall 18 above integral band 22 such that collapsed regions or dimples 50 are formed in lid component 12. This is accomplished simply by pressing fingers F against the side wall 18 of lid component 12. Alternatively, the convex top surface 20 may be pressed downwardly as indicated by arrow 60. In either event, air in the interior cavity of lid component 12 is forcibly expelled, for example as shown by arrows 72, and a suction is created within the interior chamber of the lid component. This more effectively seals the enclosed nipple N (shown in FIG. 1). Contents of the baby bottle are thus even less likely to leak or spill from the nipple into the attached lid component 12. This reduces the likelihood of messy spills when the lid component is eventually opened.

Figure 5:
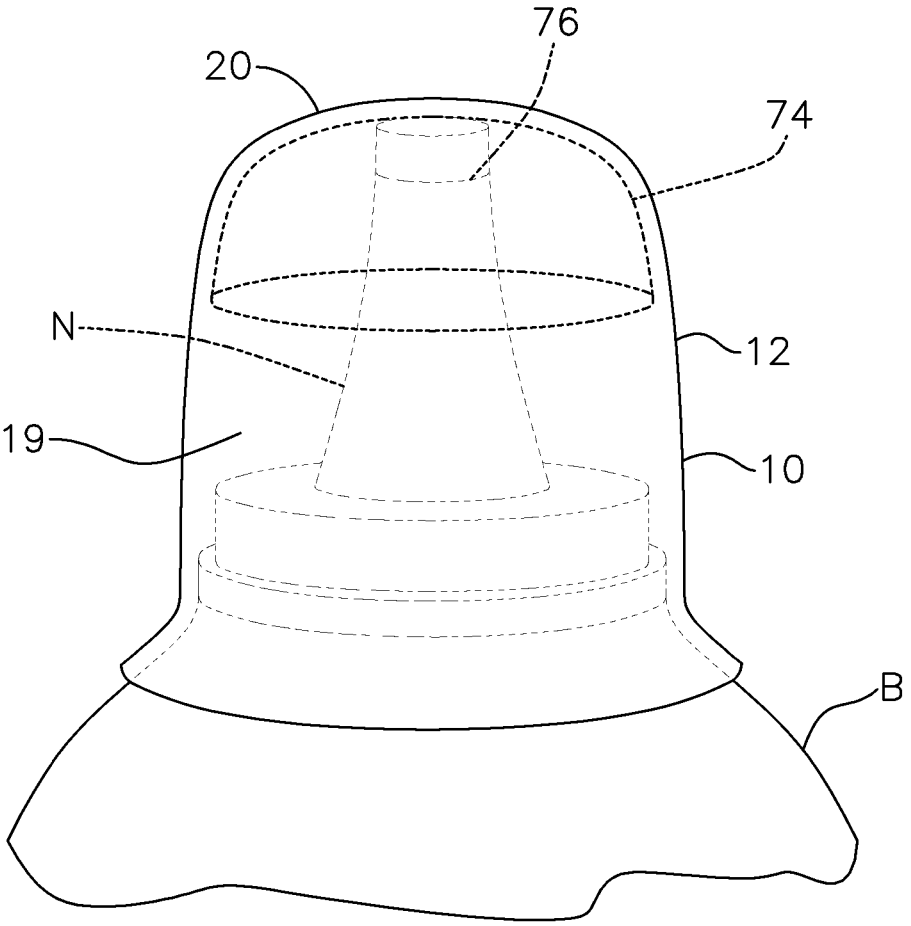
FIG. 5 is a fragmentary view of the lid component engaged with a baby bottle and including the optional dome element, which engages and seals the baby bottle nipple.

Device 10 may also be utilized in the alternative manners as shown in FIGS. 2 and 3 respectively. For example, in the embodiment shown in FIG. 2, device 10 carries an optional plastic dome element 74 which is shown in phantom. The dome element generally conforms to the shape of the interior surface at the upper end 20 of lid component 12. See also FIG. 5. Typically, dome 74 has a diameter that is generally commensurate with that of the lid component (e.g. 2-4 inches). The dome may have a height of approximately 1 inch. As shown in FIGS. 2 and 5, the interior of dome 74 carries an integral sealing ring 76 that depends from the apex of dome 74. Ring 76 is analogous to the sealing ring used in standard baby bottle lids.

Lid component 12 may be equipped with dome element 74 and utilized to sealably cover the nipple N of a baby bottle B in the manner best shown in FIG. 5. In particular, dome element 74 is removably inserted into the interior chamber 19 of flexible lid component 12 such that the outer surface of the dome conformably interengages the rounded top 20 of lid component 12. The lid component is then interengaged with the upper end of bottle B in the manner previously described. As shown in FIG. 5, this causes sealing ring 76 carried by the interior surface of dome 74 to engage and seal the upper, nozzle end of nipple N. As a result, when the lid component 12 is operatively engaged with bottle B the nipple is effectively sealed closed. Liquid in the bottle is restricted from leaking or spilling through the nipple and into the interior chamber 19 of engaged lid component 12. Spills that may otherwise occur when the lid is disengaged from the bottle are thereby significantly reduced.

The use of dome element 74 is particularly helpful if the standard lid has already been misplaced or lost or if no standard lid is provided. Because the dome element is only about 1 inch in height, it typically allows at least a portion of the peripheral wall 18 of lid component 12 to be collapsed in the manner previously described. As a result, additional suction and sealing may be accomplished by lid component 12 in versions using the dome sealing element.

Device 10 may also be utilized as shown in FIG. 3. If a standard lid or closure 40 is provided with the baby bottle, that lid may be inserted into the interior chamber of flexible lid component 12 as indicated by arrow 80. The resiliently flexible lid component 12 thereby holds and grips the standard lid 40 in a manner analogous to a snugly fitting glove. As a result, the standard lid is securely retained within the flexible lid component 12, which is in turn secured to the bottle by band 14 and connecting element 16. This provides additional security for the standard lid 40 and further reduces the possibility that the standard lid 40 may be misplaced or lost.

The flexible sealing lid and connector device of this invention may also be employed to sealably cover a wide variety of other drink containers such as sippy cups, insulated cups, travel coffee mugs, water bottles, etc. For example, FIG. 6 discloses sealing device **10*a* operatively engaged with and covering the upper end of an insulated travel cup C. Once again, device 10*a* includes a resiliently flexible lid component 12*a* that is permanently secured to a container attachment band 14*a* through a flexible connector element 16*a*. Device 10*a* again features a molded, one piece construction wherein lid component 12*a* is permanently secured to an upper end of connector element 16*a* and an attachment band 14*a* is similarly secured to the opposite end of connector element 16*a*. Silicone and other natural or synthetic materials may be employed to mold or otherwise construct device 10**. The dimensions of the individual components may be modified to accommodate the particular size of the drink container involved.

In versions wherein the sealing lid device is used for items such as travel cups, a small aperture 90 may be optionally employed in the side wall **18*a* of lid component 12*a* for accommodating a drinking straw S. The straw is typically bent within the interior chamber of lid component 12*a* and directed into the cup through the dispensing opening of the standard lid attached to cup C so that the beverage contained in cup C may be consumed through the straw. In such versions, lid component 12*a* typically includes a flat, rather than a convex or dome shape. This allows device 10*a*** to conform to and better accommodate a variety of standard flat topped lids that are commonly used with such beverage containers.

It should be understood that device **10*a* may be attached to beverage containers either with or without standard lids attached. In cases where the standard lid is not attached, the seal may be improved and leaking and spillage may be reduced by again squeezing and collapsing the lid component 12 as shown in FIG. 6. Suction and sealing will be improved in such cases by also eliminating aperture 90**.

In operation, neck **17*a* is expanded to receive and grip the circumferential wall of cup C. This allows the lid component 12*a* to securely and snugly grip the cup. As in the previously described embodiments, device 10*a* provides for a number of benefits. The engaged lid component 12*a* remains attached to cup C both when the lid component is engaged and covering the cup and when it is opened. As a result, it is virtually impossible to misplace or lose lid 12*a*. The lid component also provides an effective sealing closure, which significantly reduces spillage and leakage from the cup, as well as the possibility of misplacing or losing the original standard lid employed with the cup. That lid remains enclosed by and securely retained within lid component 12*a*** when that lid component is engaged with cup C.

It should be understood that in each of the versions disclosed herein, the suction seal may be improved by lightly wetting or moistening the interior surface of the lid component neck or the exterior surface of the engaged bottle or container prior to collapsing the attached flexible lid component.

From the foregoing it may be seen that the apparatus of this invention provides for a one-piece, flexible sealing lid and connector device for baby bottles and other types of drink containers. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A flexible sealing lid and connector device for a drink container having a liquid dispensing opening, said device comprising:

a container attachment band for wrapping around and attaching to the drink container;

an elongate flexible connector element joined at a first end to said container attachment band; and a resiliently flexible lid component secured to an opposite second end of said elongate flexible connector element, said lid component including a convex upper portion and a cylindrical lower neck portion depending from said upper portion, said neck portion terminating in a flat lower circumferential edge, which defines an entry into an interior chamber of said lid component, said neck portion being resiliently expanded to receive and sealably grip an outer periphery of the drink container such that said upper portion of said lid component is supported in an unstretched condition and encloses said interior chamber of said lid component above the drink container, whereby said lid component covers the liquid dispensing opening of the drink container said upper portion of said lid component being flexibly collapsed with said neck portion gripping the outer periphery of the drink container for expelling air from said chamber between the outer periphery of the drink container and said lower edge of said neck portion to create a suction within said chamber of said flexible lid component, which causes said neck portion to more tightly grip and seal the drink container.

2. The device of claim 1 in which said resiliently flexible lid component is secured to said connector element by a lid attachment band that unitarily interconnects said lid component to said opposite end of said elongate connector element.

3. The device of claim 1 in which said lid component includes an interior chamber for receiving a standard drink container lid.

4. The device of claim 1 in which said lid component includes an aperture for receiving a straw to communicate with an interior of the drink container.

5. The device of claim 1 in which said container attachment band, said elongate flexible connector element and said lid component are formed in a single unitary piece.

6. A flexible sealing lid and connector device for a baby bottle having a liquid dispensing nipple, said device comprising:

a bottle attachment band for wrapping around and attaching to the baby bottle;

an elongate flexible connector element joined at a first end to said bottle attachment band; and a resiliently flexible lid component secured to an opposite second end of said elongate flexible connector element, said component including a convex upper portion and a cylindrical lower neck portion depending from said upper portion, said neck portion having a uniform thickness and terminating in a flat lower circumferential edge, which defines an entry into an interior chamber of said lid component, said neck portion being resiliently expanded to receive and sealably grip an outer periphery of the baby bottle such that said upper portion of said lid component is supported in an unstretched condition and encloses said interior chamber of said lid component above the baby bottle, whereby said lid component covers the nipple of the baby bottle, said upper portion of said lid component being flexibly collapsed with said neck portion gripping the outer periphery of the baby bottle for expelling air from said chamber between the outer periphery of the baby bottle and said lower edge of said neck portion to create a suction in said chamber of said lid component, which causes said neck portion to more tightly grip the baby bottle and seal the nipple.

7. The device of claim 6 in which said bottle attachment band, said elongate flexible connector element and said lid component are formed in a single unitary piece.

8. The device of claim 6 in which said resiliently flexible lid component is secured to said connector element by a lid attachment band that unitarily interconnects said lid component to said opposite end of said elongate connector element.

9. The device of claim 6 in which said interior chamber of said lid component receives a standard baby bottle lid.

10. The device of claim 6 further including a dome-shaped element received by said flexible lid component for sealably engaging the nipple of the baby bottle when said lid component covers the nipple of the baby bottle.

11. A flexible sealing lid and baby bottle assembly comprising:

a baby bottle including a bottle body and a liquid-dispensing nipple operably attached to said bottle body;

a bottle attachment band for wrapping around and attaching to said bottle body;

an elongate flexible connector element joined at a first end to said bottle attachment band; and a resiliently flexible lid component secured to an opposite end of said elongate flexible connector element, said lid component including a convex upper portion and a cylindrical lower neck portion depending from said upper portion, said neck portion having a uniform thickness and terminating in a flat lower circumferential edge, which defines an entry into an interior chamber of said lid component, said neck portion being resiliently expanded to receive and sealably grip an outer periphery of said bottle body such that said upper portion of said lid component is supported in an unstretched condition and encloses said interior chamber above said bottle which interior chamber accommodates said liquid dispensing nipple;

said lid component being collapsed with said neck portion gripping said outer periphery of said bottle body for expelling air from said interior chamber between said outer periphery of said bottle body and said neck portion of said lid component to create a suction in said interior chamber, which causes said neck portion of said lid component to more tightly grip said bottle body and seal said nipple within said interior chamber.

12. The assembly of claim 11 in which said exterior periphery of said bottle body includes a wetted surface for increasing the sealing grip between said bottle body and said neck portion when a section is created in said interior chamber.

13. The device of claim 1 in which a liquid is disposed between the outer periphery of the drink container and said neck portion of said lid component to increase the grip and tighten the seal of the neck portion against the outer periphery of the drink container.

14. The device of claim 6 in which a liquid is disposed between the outer periphery of the drink container and said neck portion of said lid component to increase the grip and tighten the seal of the neck portion against the outer periphery of the drink container.

15. The device of claim 1 in which said cylindrical neck portion consists of smooth inner and outer surfaces.

16. The device of claim 6 in which said cylindrical neck portion consists of smooth inner and outer surfaces.

17. The assembly of claim 11 in which said cylindrical neck portion consists of smooth inner and outer surfaces.

* * * * *